US010830257B2

(12) United States Patent
Rygaard Hansen et al.

(10) Patent No.: US 10,830,257 B2
(45) Date of Patent: Nov. 10, 2020

(54) APPARATUS AND METHODS FOR THE CONTROL OF HYDRAULIC ACTUATORS

(71) Applicant: National Oilwell Varco Norway AS, Kristiansand S (NO)

(72) Inventors: Michael Rygaard Hansen, Grimstad (NO); Jesper Kirk Sørensen, Grimstad (NO)

(73) Assignee: National Oilwell Varco Norway AS (NO)

( * ) Notice: Subject to any disclaimer, the term of this patent is extended or adjusted under 35 U.S.C. 154(b) by 0 days.

(21) Appl. No.: 15/580,234

(22) PCT Filed: Jun. 8, 2016

(86) PCT No.: PCT/NO2016/050119
§ 371 (c)(1),
(2) Date: Dec. 6, 2017

(87) PCT Pub. No.: WO2016/200272
PCT Pub. Date: Dec. 15, 2016

(65) Prior Publication Data

US 2018/0180066 A1 Jun. 28, 2018

(30) Foreign Application Priority Data

Jun. 12, 2015 (EP) ..... 15171831

(51) Int. Cl.
*F15B 11/05* (2006.01)
*F15B 21/00* (2006.01)
(Continued)

(52) U.S. Cl.
CPC ..... *F15B 11/05* (2013.01); *F15B 11/10* (2013.01); *F15B 13/026* (2013.01);
(Continued)

(58) Field of Classification Search
CPC ..... F15B 11/044; F15B 11/0445; F15B 2211/635; F15B 2211/6316; F15B 11/166;
(Continued)

(56) References Cited

U.S. PATENT DOCUMENTS 4,955,194 A 9/1990 Christensen
5,138,838 A * 8/1992 Crosser ..... F15B 21/087 60/426

(Continued)

FOREIGN PATENT DOCUMENTS

EP 0379595 8/1990
EP 2667038 5/2013

(Continued)

OTHER PUBLICATIONS

English translation of abstract for EP 2667038 (2 pages).

(Continued)

*Primary Examiner* — Abiy Teka
(74) *Attorney, Agent, or Firm* — Conley Rose P.C.

(57) ABSTRACT

Methods of controlling an actuator during operation using a hydraulic circuit, and related apparatus, are described. The circuit has a first path section along which fluid is supplied to a first chamber of the actuator using a first valve and a second path section along which fluid is extracted from a second chamber of the actuator using a second valve. Pressure data associated with a pressure of the fluid supplied to the first side of the actuator are obtained, a pilot pressure pPilot is produced based on the data and the first and second valves are configured based on the pilot pressure pPilot.

27 Claims, 12 Drawing Sheets

(51) Int. Cl.

| | |
|---|---|
| ***F15B 11/10*** | (2006.01) |
| ***F15B 13/02*** | (2006.01) |
| ***F15B 13/04*** | (2006.01) |
| ***F15B 13/042*** | (2006.01) |

(52) U.S. Cl.
CPC ..... *F15B 13/029* (2013.01); *F15B 13/0417* (2013.01); *F15B 13/0426* (2013.01); *F15B 21/001* (2013.01); *F15B 21/008* (2013.01); *F15B 2211/20546* (2013.01); *F15B 2211/3053* (2013.01); *F15B 2211/30535* (2013.01); *F15B 2211/5059* (2013.01); *F15B 2211/50536* (2013.01); *F15B 2211/50581* (2013.01); *F15B 2211/526* (2013.01); *F15B 2211/528* (2013.01); *F15B 2211/575* (2013.01); *F15B 2211/6057* (2013.01); *F15B 2211/6313* (2013.01); *F15B 2211/6316* (2013.01); *F15B 2211/6355* (2013.01); *F15B 2211/652* (2013.01); *F15B 2211/6653* (2013.01); *F15B 2211/6656* (2013.01); *F15B 2211/67* (2013.01); *F15B 2211/7053* (2013.01); *F15B 2211/7058* (2013.01); *F15B 2211/75* (2013.01); *F15B 2211/761* (2013.01); *F15B 2211/857* (2013.01); *F15B 2211/8613* (2013.01); *F15B 2211/8616* (2013.01)

(58) Field of Classification Search
CPC ..... F15B 11/05; F15B 21/008; F15B 21/001; F15B 13/0426; F15B 13/029; F15B 13/026; F15B 11/10
See application file for complete search history.

(56) References Cited

U.S. PATENT DOCUMENTS

| | | | | |
|---|---|---|---|---|
| 2003/0121409 | A1* | 7/2003 | Lunzman ..... | E02F 9/2207 91/459 |
| 2013/0298541 | A1* | 11/2013 | Carlin ..... | F15B 1/04 60/327 |

FOREIGN PATENT DOCUMENTS

| | | | |
|---|---|---|---|
| EP | 2667038 | A2 * | 11/2013 |
| WO | 2016200272 | | 12/2016 |

OTHER PUBLICATIONS

Written Opinion for PCT/NO2016/050119 dated Aug. 31, 2016 (8 pages).
International Search Report for PCT/NO2016/050119 dated Aug. 31, 2016 (5 pages).

* cited by examiner

FIG. 1 -PRIOR ART-

FIG. 2 -PRIOR ART-

APPARATUS AND METHODS FOR THE CONTROL OF HYDRAULIC ACTUATORS

CROSS REFERENCE TO RELATED APPLICATIONS

This application is the U.S. National Stage entry under 35 U.S.C. § 371 of International Patent Application No. PCT/NO2016/050119, filed Jun. 8, 2016, and entitled "Improvements in the Control of Hydraulic Actuators," and European Patent Application EP15171831.9 filed Jun. 12, 2015, which are hereby incorporated by reference in their entirety for all purposes.

TECHNICAL FIELD

The present disclosure relates in particular to the operation and control of hydraulic actuators.

BACKGROUND

Hydraulic actuators are used in a wide range of industrial applications for handling loads. Examples include uses for example in large-scale industrial apparatus for lifting and manipulating heavy equipment, such as cranes, elevators, manipulator arms or the like. Such apparatus are typically supplied with power fluid for driving the actuators through a hydraulic circuit. The circuit may include components such as valves or the like which are configured in response to a sensed load on the actuator to operate and control the actuator appropriately. Components in such circuits may operate under data control for example electrically by supplying electrical control signals to the components and/or under fluid control by supplying a control fluid to the components, but at the same time it is typically of interest that such control arrangements avoid unnecessary complexity. In large-scale equipment, power requirements for the actuators may be substantial and as such prevailing thinking has been to keep both the power supply and control circuitry straightforward and reliable, for reducing potential failures in the hydraulic circuitry or actuator where such an eventuality could be safety concern and be costly to rectify. In harsh environments, such as on marine platforms or vessels, for example in the oil and gas exploration and production industry, provision of simple, reliable and safe systems for delivering hydraulic operability of this kind has been paramount. Downtime due to failures in equipment in this industry can also be very costly.

In FIG. 1, there is shown a prior art hydraulic circuit 2 used for providing an actuator 3 with hydraulic power for operating the actuator 3. The actuator 3 has a piston 3*p* which is movable within a piston housing 3*h* back or forth as indicated by the arrow 3*c* by the application of pressure by hydraulic power fluid against the piston 3*p* on a first side 3*a* (moving the piston toward the second side 3*b*) or against the piston on a second side 3*b* (moving the piston toward the first side 3*a*).

The hydraulic power fluid is supplied from a tank 4 with the assistance of a pump 5, and is guided through the circuit 2 to the first or second sides 3*a*, 3*b* of the actuator 3 as appropriate. Power fluid is supplied into a chamber in the piston housing 3*h* on one of the sides 3*a*, 3*b*, causing movement of the piston 3*p* toward the other side, whilst power fluid is expelled from the chamber in the piston housing 3*h* on the other of the sides 3*a*, 3*b* and is guided back through the circuit to a drain 6 along a drain line 13.

The power fluid is guided into the actuator via line 8 or line 7. To facilitate this, the circuit 1 has load-sensing directional control valve 9. The configuration of the directional control valve 9 determines the route for the hydraulic power fluid from the pump 5 to the actuator 3. In FIG. 1, the load-sensing directional control valve 9 is shown in a neutral position, in which no movement of the piston 3*p* is taking place. However, it will be appreciated that upon activating the directional control valve 9 (toward the left hand side as viewed in the figure such that the block 9*a* is active), power fluid is directed from the pump 5 into the line 7 and into the first side 3*a* of the actuator 3, urging the piston toward the second side 3*b*. Returning power fluid is then extracted from the second side 3*b* of the actuator via the line 8 to the drain line 13.

The load exerted on the actuator 3 may vary, and in view of this, the circuit 2 includes certain control measures. Firstly, the circuit 2 is provided with a pressure compensating valve 10. The pressure compensating valve 10 is configured to adjust the flow of power fluid from the pump 5 so that a suitable pressure is applied so that the piston 3*b* is moved at a particular speed. Secondly, the circuit 2 is provided with a counterbalance valve 11. The counterbalance valve 11 is configured to adjust the flow of returning power fluid from the actuator 3 to control the pressure on the second side 3*b* of the actuator 3 against which the piston 3*p* needs to act. This is intended to help to control the speed and stop the piston 3*p* running away in the event of load components which may be exerted in the same direction as the piston movement. In this way, the circuit 2 using the counterbalance valve 11 and the pressure compensating valve 10 provides a way for the speed of the actuator 3 to be independent of the load and for overrunning loads to be handled.

Nevertheless, the circuit 2 can experience practical difficulties in that instabilities can appear over time leading to a loss of control of movement of the piston 3*p*, e.g. in the event of overrunning loads, which in turn may cause cavitation damage in the metering-in line 7 (or line 8 which is the metering-in line when moving in the other direction) and/or damage to the piston 3*p* and/or the piston housing 3*h*. It is also typically desirable to ensure that the movement of the actuator 3, e.g. speed of piston 3*b*, is unchanged over a range of different loads, in order to handle loads safely and predictably. This issue can be further understood by further considering the operation of the counterbalance valve 11 and the pressure compensation valve 10 in FIG. 1.

The counterbalance valve 11 is controlled using control lines 11*a*, 11*b* which supply control fluid to the valve 11 for configuring the valve, e.g. positioning a valve spool so as to restrict or permit fluid flow through the valve by an amount determined by the control fluid in the control lines 11*a*, 11*b*. The control line 11*a* is connected to the line 7 supplying fluid to the first side 3*a* of the actuator 3, and the control line 11*b* is connected to the line 8 from the second side 3*b* of the actuator. In this way, the valve 11 can sense the pressure in the power fluid being supplied to the first side 3*a* in line 7 and the pressure in the returning power fluid from the second side 3*b* of the actuator in line 8, and is configured according to the difference in pressure between the first and second sides 3*a*, 3*b* of the actuator 3. In the event that the actuator 3 experiences an overrunning load, for example, an effect is produced on the pressures in the power fluid on the first and second sides 3*a*, 3*b* of the actuator, and the valve responds accordingly through the control lines 11*a*, 11*b* to configure the valve to limit the flow out of the second side 3*b* actuator to resist the load, to restore the pressure differential.

The pressure compensating valve 10 is controlled using control lines 10*a*, 10*b* which supply control fluid to the valve 10 for configuring the valve, e.g. by positioning a valve spool so as to restrict or permit fluid flow from the pump 5 through the valve by an amount determined by the control pressure in the control lines 10*a*, 10*b*. As can be seen, the control line 10*a* is connected to an outlet side of the load-sensing directional control valve 9, which when block 9*a* is active (for moving the actuator piston 3*p* toward the second side 3*b*), senses the pressure in the power fluid being supplied into the first side of the piston via line 7. The control line 10*b* is connected to the inlet side of the load-sensing directional control valve 9 which senses the pressure of the power fluid being supplied into the directional control valve 9 through supply line 12. The valve therefore adjusts to compensate for any pressure drop in the power fluid across the load-sensing directional control valve 9. The pressure compensating valve 10 is further configured to allow an increased or decreased flow into the first side of the actuator 3*a* to facilitate the same speed of movement of the piston 3*p* for different loads. In the event of a change in load, e.g. an overrunning load, pressure effects in the first side 3*a* of the actuator 3*c* can lead to the valve 10 increasing or decreasing the pressure in line 12 to maintain the same pressure drop in the fluid flowing through the directional control valve 9 from line 12 to line 7 via block 9*a*, thereby counteracting the influence of the pressure effect on the speed of the actuator 3.

The actuator 3, in particular the speed and movement of the piston 3*p* when handling loads, is therefore controlled by way of counterbalance valve 11 and the pressure compensating valve 10 acting and cooperating together. However, valve responses to the load conditions can be imperfect in terms of timings, such that short duration, high frequency pressure perturbations may occur in the power fluid in the metering-in line 7 to the first side 3*a* of the actuator 3*a*. Such instabilities may amplify over time, and jeopardize the performance of the actuator 3 in handling loads and adversely affect safety. In particular, the actuator 3 may become susceptible to sudden movements and damage as described above in the event of overrunning loads.

Various solutions have been proposed to deal with this instability issue where additional valves or modifications to the counterbalance valve 11 and/or pressure compensation valve 10 are made but where to their detriment they give up much of the functionality to ensure that the speed of movement of the piston 3*p* is independent of the load, whilst the effects of overrunning loads are counteracted.

It will be noted that FIG. 1 shows the features of the hydraulic circuit 2 to be used for movement of the piston 3*p* toward the second side 3*b* of the actuator 3. However, the actuator 3 in the example is two-way movable, and as such, the arrangement of the counter balance valve 11 acting on the returning power fluid would in practice also be mirrored on the other side of the actuator 3 for when the piston 3*p* moves in the opposite direction toward the first side 3*a* (and the directional control valve is switched with a second block 3*b* active), although this is not shown in FIG. 1 for purposes of clarity. In FIG. 2, the apparatus of FIG. 1 is shown including this mirrored arrangement including a second counterbalance valve 11', operating under control from control lines 11*a*' and 11*b*', and a second check valve 14'. The valves 11' and 14' are active to control the overrunning load when the piston 3*p* is moving toward the first side 3*a*.

In addition, it can be noted that FIG. 1 shows the neutral configuration of the circuit 2 in which the piston 3*p* is in a stationary position, where a third block 3*c* of the load sensing directional control valve 9 is being applied. In this configuration, flow from the pump 5 into the actuator 3 is disconnected and the first side 3*a* of the actuator 3 is depressurized. The pressure in the second side 3*b* of the actuator 3 adjusts to maintain the equilibrium with external load on the piston 3*p*. The check valve 14 and the counter balance valve 11 remain closed.

BRIEF SUMMARY OF THE DISCLOSURE

In light of the above, according to a first aspect of the disclosure, there is provided a method of controlling an actuator during operation of a hydraulic circuit, the circuit comprising a first path section along which fluid is supplied to a first chamber of the actuator using a first valve, and a second path section along which fluid is extracted from a second chamber of the actuator using a second valve, the method comprising the steps of:

(a) obtaining pressure data associated with a pressure of the fluid supplied to the first side of the actuator;

(b) producing a pilot pressure pPilot based on the data; and (c) configuring either or both of the first and second valves using the pilot pressure pPilot.

The pressure data may typically comprise a signal of the pressure in the fluid supplied to the first chamber.

The actuator typically comprises a moving component, movable in dependence upon the pressure of the fluid in said first and/or second chambers, e.g. according to a pressure differential therebetween. The moving component may be for example a piston arm, shaft or rod or the like.

The obtained pressure data may be first pressure data, and the method may further comprise processing the first pressure data to produce second pressure data, wherein the pilot pressure is produced based upon the second pressure data. At least one component from the first pressure data may be preserved in the produced second pressure data.

The obtained pressure data may be first pressure data, and the method may further comprise processing the first pressure data to determine at least one set pressure pSet for determining the pilot pressure.

The step of processing the first pressure data to obtain the second pressure data may comprise filtering the first pressure data. Thus, the first pressure data may be processed to remove at least one frequency component. Accordingly, the step of processing the first pressure data to obtain the second pressure data may be performed to remove high frequency components. The second pressure data, e.g. time-series data, may thus be based on the first data, without the removed high-frequency component or components. The second pressure data obtained may therefore typically not contain the removed component or components.

The step of filtering may be performed to remove one or more high-frequency components may be removed. The step of filtering may comprise applying a low-pass filter to the first pressure data.

The pilot pressure pPilot may typically be produced using a third valve operable to configure a valve control path. In this way, the third valve may be operable for adjusting a pressure in a control fluid in the valve control path, e.g. within a control fluid circuit.

The method may further comprise generating a control signal uProp based on the second pressure data. The method may include passing the control signal uProp to a third valve to produce the pilot pressure pPilot for configuring either or both of the first and second valves. The third valve may be a pressure relief valve operable to configure a valve control path for adjusting a pressure in a control fluid in the path. The third valve may be a pressure reducing valve operable for configuring a valve control path for adjusting a pressure in a control fluid in the valve control path.

The method may further comprise measuring the produced pilot pressure pPilot, comparing the measured pilot pressure pPilot with the second pressure data, and updating the control signal uProp in dependence upon the comparison.

The first valve may preferably comprise a pressure compensating valve. The pressure compensating may typically be operable for adjusting a pressure of the fluid in the first path section, and/or the first chamber. In doing so, the pressure compensating valve may be operable to configure an inlet pathway for supplying fluid into an inlet of a load-sensing directional control valve.

The second valve may preferably be a counterbalance valve. The counterbalance valve may typically be operable for resisting undesired movement of the actuator. The counterbalance valve may be operable to configure the second path section.

The first and second valves may preferably be configured to be operable to maintain an actuator speed that is independent of external disturbances on the actuator. The first and second valves may cooperate to protect the actuator from being affected by external force components or changes in such force components during movement. Such force components may result from a load such as an overrunning load, or changes in such a load, on the actuator or the moving component thereof.

The first path section may comprise a metering-in line.

The pressure data associated with the pressure in the fluid supplied to the first side of the actuator may comprise at least one pressure pLS of the fluid at an outlet of a load sensing directional control valve.

The method may further comprise measuring at least one pressure pLS to obtain the data. The data may typically be obtained using a pressure transducer.

According to a second aspect of the disclosure, there is provided apparatus for operating and controlling a hydraulic actuator, the apparatus comprising:

first and second valves;

a first path section along which fluid is supplied to a first chamber of the actuator using the first valve;

a second path section along which fluid is extracted from a second chamber of the actuator using the second valve; and at least one device for producing a pilot pressure pPilot based upon obtained data associated with a pressure of the fluid supplied to the first chamber of the actuator, wherein either or both of the first and second valves are configured using the pilot pressure pPilot.

The apparatus may further comprise the actuator. The device may typically comprise a third valve.

The device may comprise any one or more of: a determiner; a controller; and control structure.

The apparatus may further comprise a control fluid circuit, or a component thereof, for controlling the first and second valves.

According to a third aspect of the disclosure, there is provided a computer device for use in operating and controlling an actuator operable using a hydraulic circuit comprising a path section along which fluid is supplied to a first chamber of the actuator using a first valve, and a path section along which fluid is extracted from a second chamber of the actuator using a second valve, the computer device being configured to receive data associated with a pressure of the fluid supplied to the first chamber of the actuator, for determining a pilot pressure pPilot to be generated based upon the obtained data for configuring either or both of the first and second valves.

According to a fourth aspect of the disclosure, there is provided a computer program for the computer device of the third aspect.

According to a fifth aspect of the disclosure, there is provided a method of controlling an actuator during operation of a hydraulic circuit comprising a first path section along which fluid is supplied to a first chamber of the actuator using a first valve, and a second path section along which fluid is extracted from a second chamber of the actuator using a second valve, the method comprising the steps of:

(a) computing a set pressure pSet in dependence upon a pressure of the fluid supplied to the first chamber of the actuator; and (b) configuring either or both of the first and second valves based on the computed set pressure.

The method may further comprise producing a pilot pressure pPilot based on the set pressure pSet; and configuring the first and second valves using the pilot pressure pPilot.

According to a sixth aspect of the disclosure, there is provided apparatus for use in controlling an actuator during operation of a hydraulic circuit comprising, the apparatus comprising:

first and second valves;

a first path section along which fluid is supplied to a first chamber of the actuator using the first valve;

a second path section along which fluid is extracted from a second chamber of the actuator using the second valve; and at least one device for computing a set pressure pSet in dependence upon a pressure of the fluid supplied to the first chamber of the actuator for configuring either or both of the first and second valves based on the computed set pressure.

According a seventh aspect of the disclosure, there is provided a computer device for use in controlling an actuator operable using a hydraulic circuit comprising a path section along which fluid is supplied to a first chamber of the actuator using a first valve, and a path section along which fluid is extracted from a second chamber of the actuator using a second valve, the computer device being configured to compute a set pressure pSet in dependence upon a pressure of the fluid supplied to the first chamber of the actuator, the computed set pressure to be used for configuring either or both of the first and second valves.

According to an eighth aspect of the disclosure, there is provided a computer program for the computer device of the seventh aspect.

Any of the aspects of the disclosure may include further features as described in relation to any other aspect, wherever described herein. Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment. Embodiments of the claimed invention are advantageous in various ways as will be apparent from the specification throughout.

BRIEF DESCRIPTION OF THE DRAWINGS

There will now be described, by way of example only, exemplary embodiments of the invention with reference to the accompanying drawings, in which.

DETAILED DESCRIPTION OF THE DISCLOSED EXEMPLARY EMBODIMENTS

Figure 1:
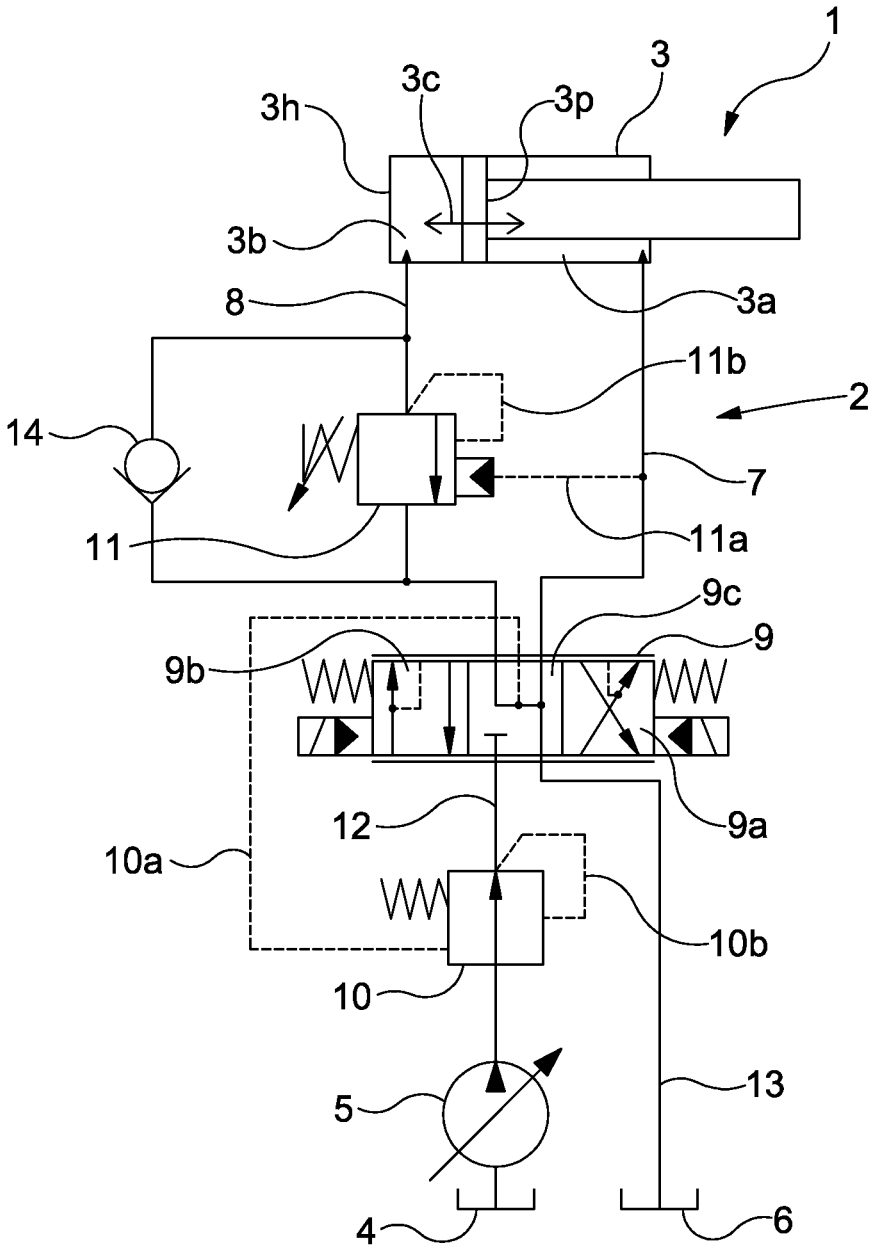
FIG. 1 is a diagram of prior art apparatus for controlling an actuator.
Figure 2:
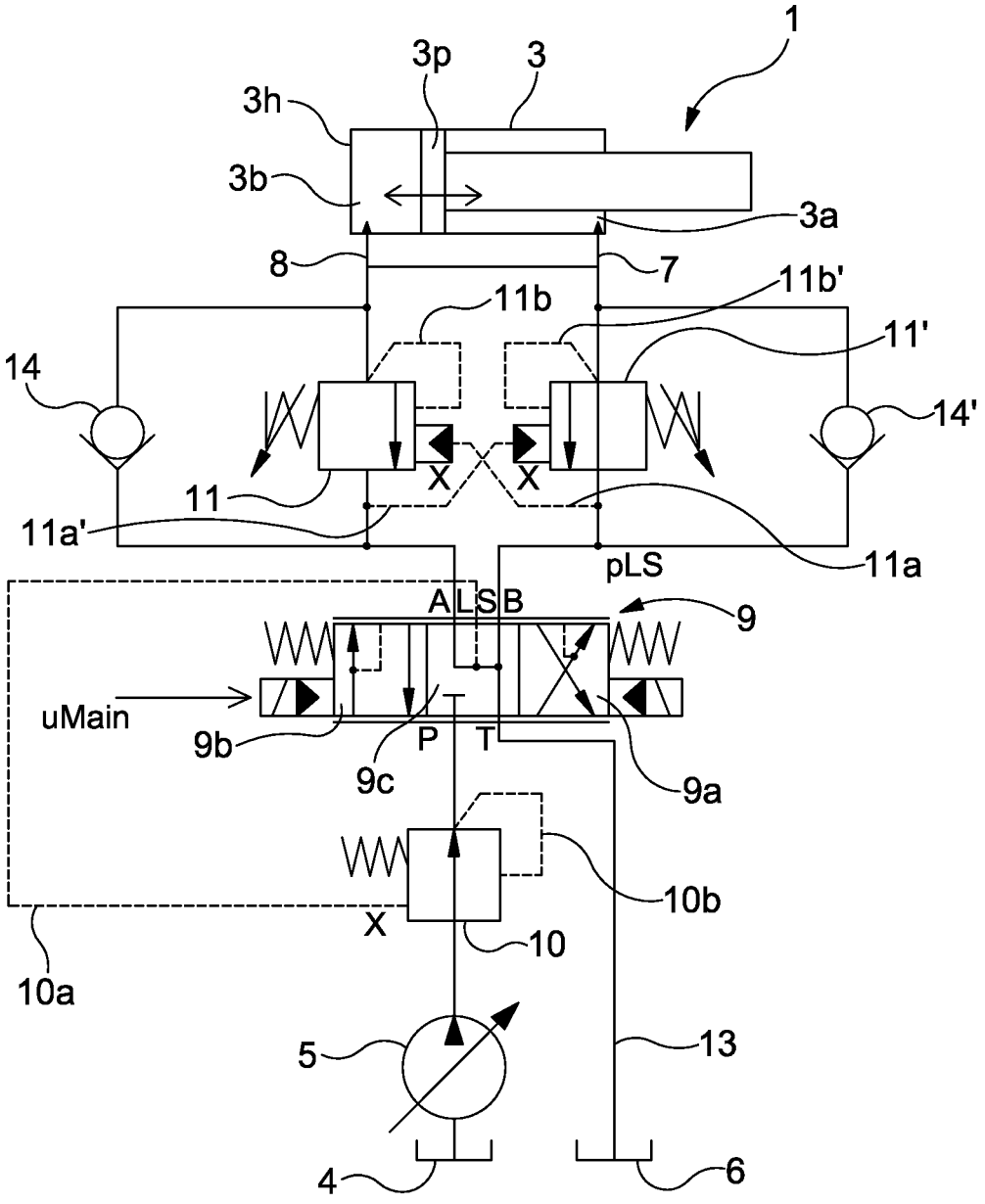
FIG. 2 is a diagram of the prior art apparatus for controlling the actuator of FIG. 1 showing additional structure.
Figure 3:
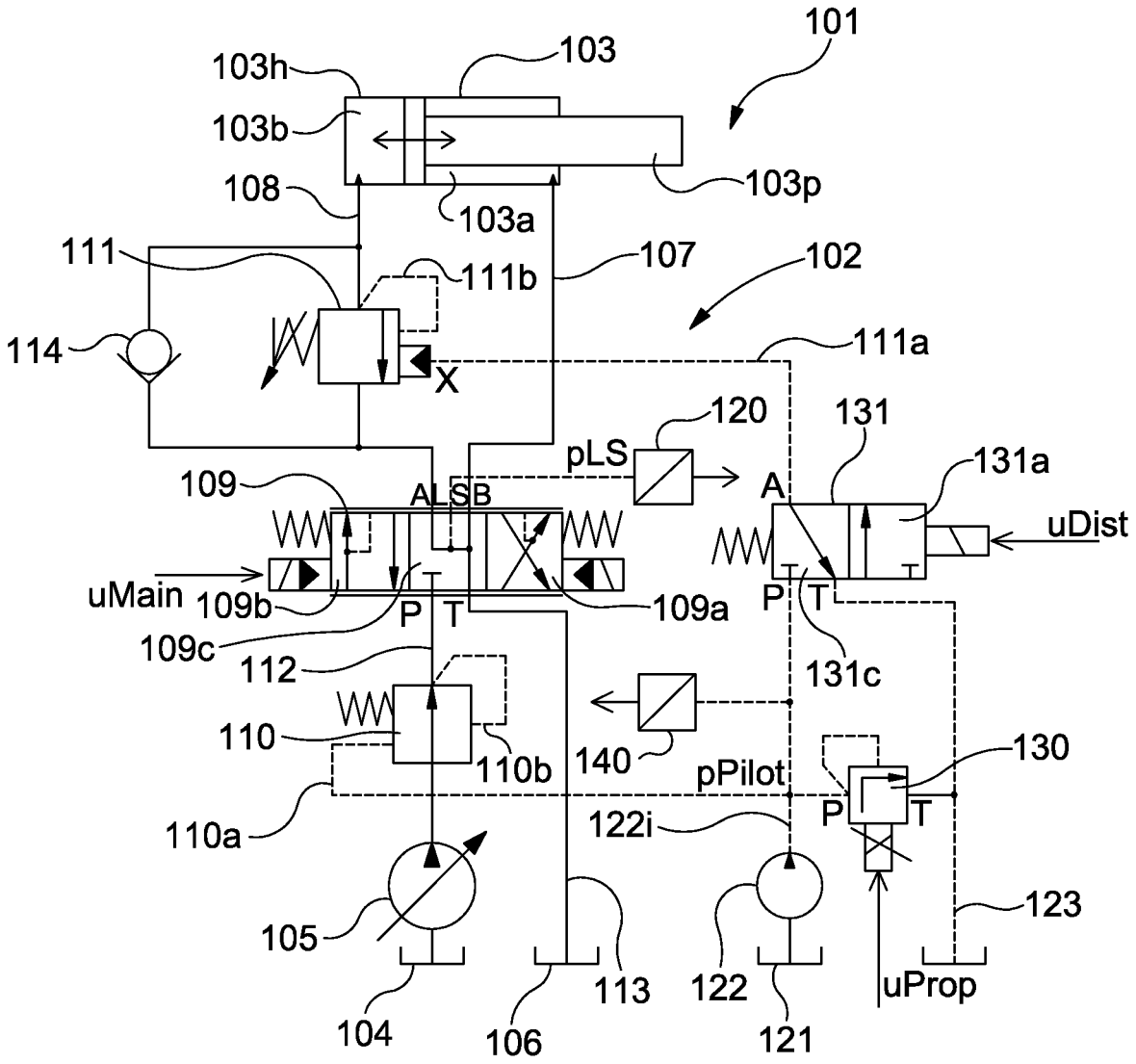
FIG. 3 is a diagram of apparatus for controlling an actuator according to an embodiment of the invention.
Figure 4:
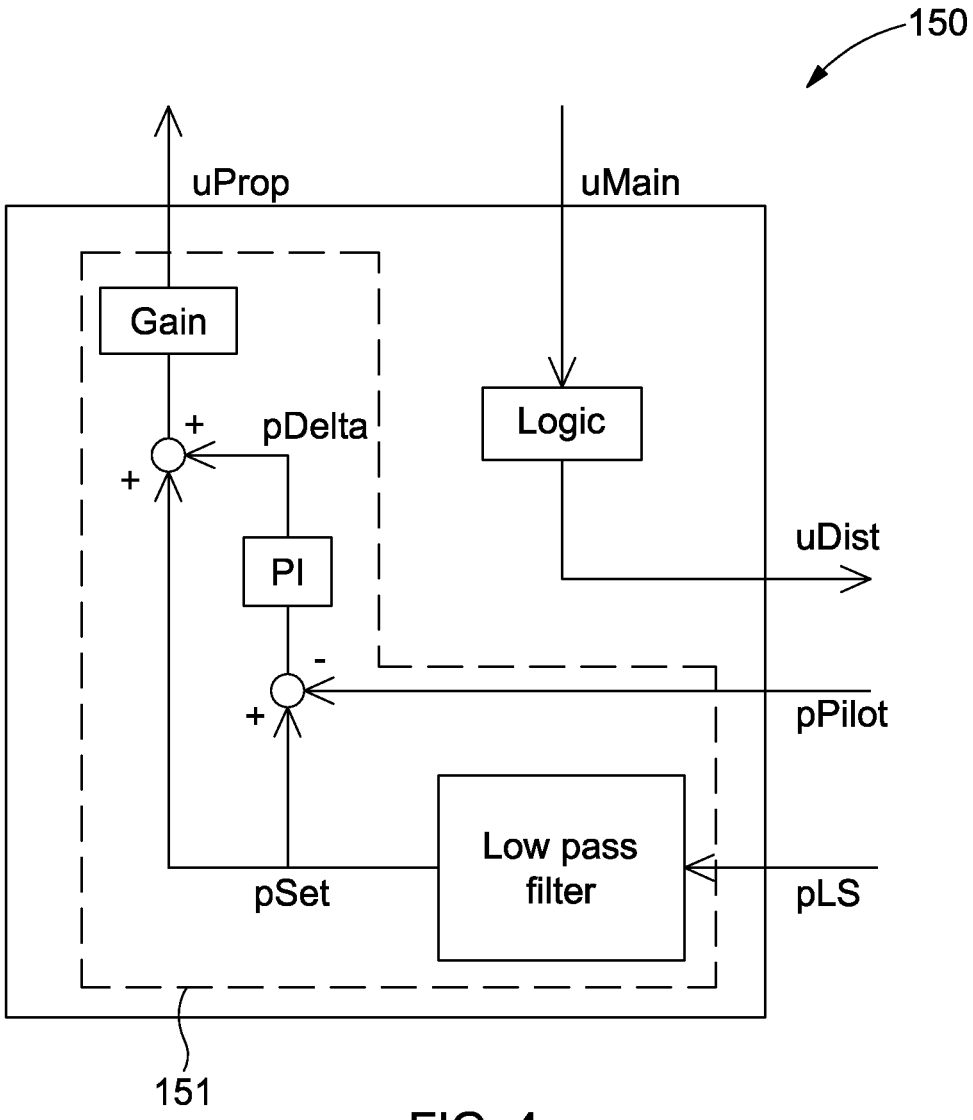
FIG. 4 is a representation of a control structure in the apparatus of FIG. 3.

Reference is made firstly to FIGS. 3 and 4. In FIG. 3, there is shown apparatus 101 having a hydraulic circuit 102 which is used for providing an actuator 103 with hydraulic power for operating and controlling the actuator 103.

The circuit 102 has a pressure compensating valve 110 and a counterbalance valve 111 which are configured using a pilot pressure pPilot which is generated based upon a determined pressure pSet. The pressure pSet is determined using a control structure 150. A pressure pLS is measured using a transducer 120 and is passed to a determiner 151 in the control structure 150 as an input, and the pressure pLS is processed in order to determine the pressure pSet for generating the pilot pressure pPilot. The pressure pLS is processed in the determiner 151 by applying a low-pass filter to the pressure pLS, in order to obtain the set pressure pSet. In this way, the set pressure pSet is obtained in dependence upon the pressure as measured in the line 107 with a high frequency component filtered out. This technique can therefore provide an improved basis for configuring the counterbalance valve 111 and the pressure compensating valve 110. The functionality of the counterbalance valve 111 and pressure compensating valve 110 to control the actuator 103 under external loads may thus be improved as the valves 110, 111 can respond on the basis of the pressure in the metering-in line 107 (since the set pressure pSet is based upon the pressure pLS), whilst the processing performed in the control structure 150 can help to suppress instabilities as may be suffered by the prior art.

Figure 5:
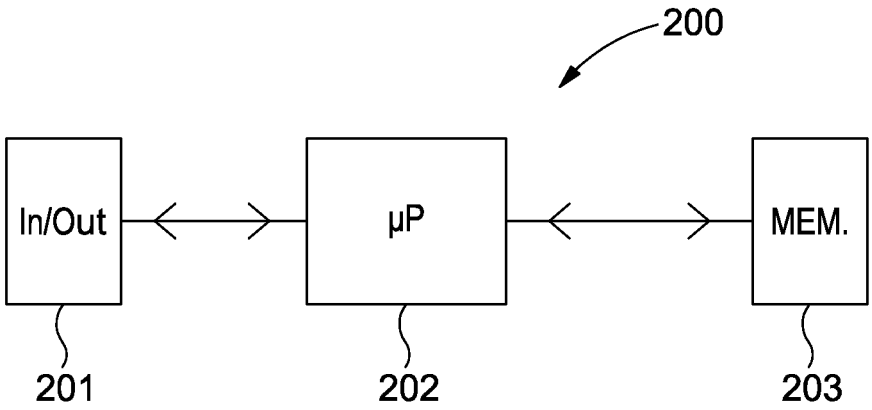
FIG. 5 is a representation of a computer device for implementing the control structure of FIG. 4.

FIG. 5 shows a computer device 200 including an In/Out unit 201 through which the inputs and outputs of the control structure 150 are conveyed. The computer device 200 further comprises memory 203 for storing any of: data; computer programs and/or machine readable instructions. For example, a computer program for processing a signal of the pressure pLS may be stored using the memory 203. The computer device 200 also includes a microprocessor 202 that can be used for any of processing data, executing programs and/or performing instructions, for implementing the control structure 150. Preferably, the computer device 200 is in the form of a programmable logic controller. It will be appreciated that the control structure 150 and/or the determiner 151 in order to provide its function in determining the pressure pSet could be provided by other forms of apparatus.

Whilst this example illustrates that the pressure pLS may be subjected to filtering, it will be understood that other operations may be applied in order to determine a suitable pressure pSet for generating the pilot pressure pPilot. Such operations may for example include removing a noise component, performing signal smoothing or averaging, analysing or performing an estimation using the pressure pLS. In doing so, empirical or numerical methods could be used.

The pilot pressure pPilot is communicated through control lines 110*a*, 111*a* to the 'X' ports of the valves 110, 111 to configure them accordingly. In order to generate the pilot pressure pPilot, the determiner 150 is used to control a proportional pressure relief valve 130, which is used to adjust the pressure of control fluid in the lines 110*a*, 111*a* to correspond with the pressure pSet. A uProp signal is generated based on pSet and is passed to the proportional pressure relief valve 130 to operate it appropriately. The uProp signal is output from the In/Out unit 201 of the computer device 200.

Referring again to FIG. 3, the apparatus 101 includes a control fluid tank 121 and control fluid pump 122 for providing a supply of control fluid through a supply line 122*i*. A control fluid drain line 123 is provided for draining away control fluid. The proportional pressure relief valve 130 is arranged between the pump 122 and the drain line 123, and is adjustable, e.g. by a movable valve spool to bleed off control fluid to a drain, to control communication of control fluid between the supply line 122*i* and the drain line 123. Thus, the pressure of control fluid in the supply line 122*i* (and hence the lines 110*a*, 111*b* which the supply line supplies) can be determined by the proportional pressure relief valve 130, so as to achieve the appropriate pilot pressure pPilot.

It can be noted further in FIG. 3 that the apparatus 101 includes a pressure distribution valve 131. When a piston 103*p* of the actuator 103 is being moved toward the second side 103*b* (upon application of power fluid into a chamber on a first side 103*a* of the actuator 103), block 131*a* of the pressure distribution valve 131 is active and control fluid at the pilot pressure pPilot is communicated through the valve 131 into the line 111*a* and into the port X of the counterbalance valve 111. In FIG. 3, both a load-sensing directional control valve 109 and the pressure distribution valve 131 are in the neutral configuration (blocks 109*c* and 131*c* active), with the actuator 103 stationary. In this neutral configuration, the pressure port 'X' in the counterbalance valve 111 is in communication with the drain line 123, and both the supply of the control fluid via pump 122 and supply of power fluid via pump 105 are disconnected.

When the apparatus 101 is used to move the piston 103*p*, an input signal uMain is passed to the directional control valve 109 to activate the relevant block 109*a* and an input signal uDist, based upon the input signal uMain, is sent from the determiner 150 to the pressure distribution valve 131 in order to activate the block 109*a* so as to communicate the pilot pressure pPilot for configuring the pressure compensating valve 110 and counterbalance valve 111 as described above.

In general, operation is such that a pilot pressure is generated using the determiner 150 on an ongoing basis. The pressure pLS is received and the pressure pSet produced by the determiner as time-series data, and the determiner 150 sends a time-series command signal uProp to the pressure relief valve 130 accordingly. The pilot pressure pPilot generated in the control fluid is thus updated over time, e.g. continuously and/or automatically.

In order to facilitate proper generation of the pilot pressure, the generated pressure pPilot is measured using a pressure transducer 140 and is fed back to the determiner 150 as an input. The measured pilot pressure pPilot and the set pressure pSet are compared for checking agreement between the pressure pPilot actually generated and the determined set pressure pSet. A proportional integral (PI)-control function is used to determine any difference pDelta between the measured pressure pPilot generated in the fluid and the pressure pSet, and applies a gain to the pressure pSet signal if appropriate. The signal uProp is then communicated accordingly, taking into account the gain, to control the pilot pressure pPilot being generated in the fluid via the proportional pressure relief valve 130.

Figure 6:
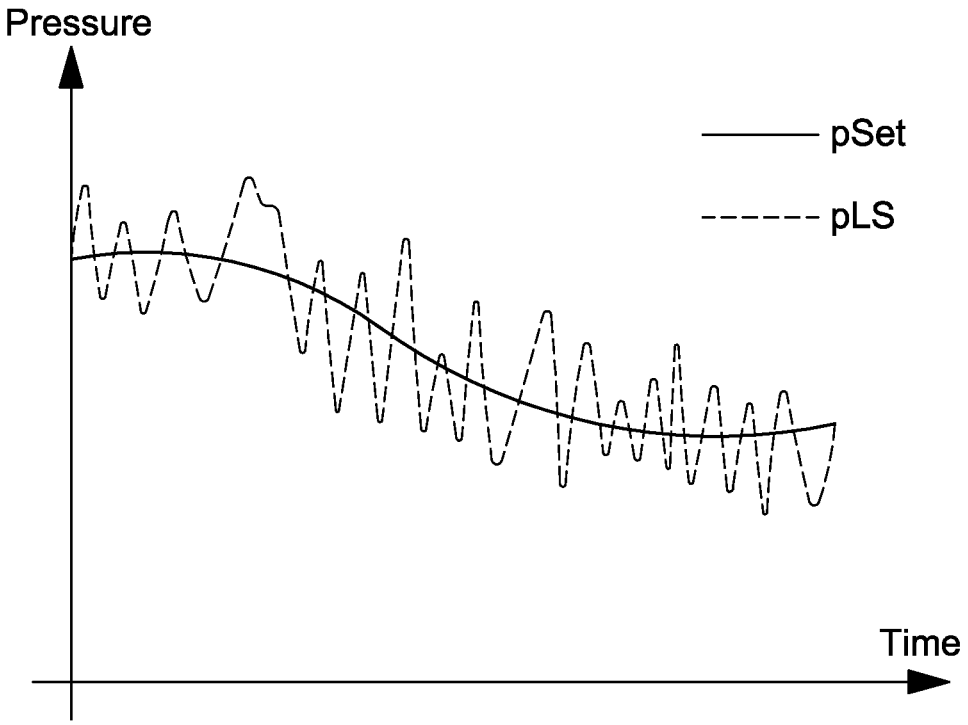
FIG. 6 is a graph of pressure curve results from the apparatus of FIG. 3 in use.

FIG. 6 shows time-series plots of data showing the signal of the measured pressure pLS and that of the resulting set pressure pSet after low pass filtering of the signal of the measured pressure pLS. As can be seen, the set pressure pSet after filtering does not contain the high-frequency fluctuations of the pressure pLS observed by measurement of the fluid. Nevertheless, the computed set pressure pSet includes the longer period variations observed in the pressure pLS, so that appropriate configuration of valves 110, 111 can be made to control the actuator 103.

With reference again to FIG. 3, in further detail, it can be noted that the piston 103*p* of the actuator 103 is movable within a piston housing 103*h* under control of the pressure compensating valve 110 and the counterbalance valve 111. The piston 103 is bi-directionally movable by hydraulic power fluid acting in a chamber on the first side 103*a* of the actuator 103 for moving the piston 103*p* toward a second side 103*b* or by hydraulic power fluid acting in a chamber on the second side 103*b* of the actuator 103 for moving the piston 103*p* toward the first side 103*a*. The power fluid is supplied through the circuit 102 to the appropriate chamber. The pump 105 is used for supplying the hydraulic power fluid from a tank 104. The chambers on the first and second sides 103*a*, 103*b* operate such that movement of the piston 103*p*, e.g. toward the second side 103*b* by the fluid supplied into the chamber at the first side 103*a*, is resisted by power fluid in the other chamber. Accordingly, with a first body of hydraulic power fluid being supplied into one of the sides 103*a*, 103*b*, a second body of hydraulic power fluid is expelled from the chamber on the other of those sides 103*a*, 103*b*. The power fluid is led into the relevant chamber of the actuator 103 via line 108 or line 107 as appropriate, facilitated by the load-sensing directional control valve 109. It will be appreciated that the configuration of the directional control valve 109 determines the route for the hydraulic power fluid from the pump 105 to the actuator 103. The load-sensing directional control valve 109 is shown in FIG. 3 in a neutral position, in which no movement of the piston 103*p* is taking place. However, upon activating the directional control valve 109 toward the left hand side as viewed in the figure such that the block 109*a* is active whereby ports A and T are connected and ports B and P are connected, power fluid can be directed from the pump 105 into the line 107 and into the first side 103*a* of the actuator 103, for urging the piston 103*p* toward the second side 103*b*. Returning power fluid can then be extracted from the second side 103*b* of the actuator via the line 108 to the drain line 113 to a drain 106.

The pressure compensating valve 110 is configured to adjust the flow of power fluid from the pump 105 so that a suitable pressure is applied for moving the piston 103*p* at a certain speed. The counterbalance valve 111 can adjust the flow of returning power fluid from the actuator 103 to control the pressure in the chamber on the second side 103*b* against which the piston 103*p* needs to act to maintain the speed (when moving for example toward the second side 103*b*). In the event of variations in the load, the counterbalance valve 111 can adjust the path for fluid out of the second side 103*b* in order to maintain the speed of the piston 103*p* independently of the load, e.g. to maintain a pressure differential between the chambers on the first and second sides 103*a*, 103*b* of the actuator. Control of the valves 110, 111 using the pilot pressure generated as described above facilitates correct performance of the counterbalance valve 111 and the pressure compensating valve 110 such that potential instabilities as may arise by operation of the valves in the presence of overrunning or other externally imparted loads can be suppressed or prevented.

It can further be noted that the pressure compensating valve 110 is controlled according to the pressures in control lines 110*a*, 110*b* e.g. by positioning a valve spool as determined by the pressure in the control lines 110*a*, 110*b*. In this way, the pilot pressure in the control line 110*a* can control the valve 110 so as to configure the path for power fluid through the valve 110. The control line 110*b* is connected to the inlet side of the load-sensing directional control valve 109 and senses the pressure of the power fluid being supplied into the directional control valve 109 through supply line 112.

The counterbalance valve 111 is controlled according to the pressures in control lines 111*a*, 111*b*, e.g. by positioning a valve spool so as to restrict or permit fluid flow through the valve 111 by an amount determined by the pressure in the control lines 111*a*, 111*b*. In this way, the pilot pressure in the control line 111*a* can control the valve 111 so as to configure the path for power fluid through the valve 111. The control line 111*b* is connected to the line 108 from the second side 103*b* of the actuator 103 so as to sense the pressure in the returning power fluid from the second side 103*b* of the actuator in line 108.

FIG. 3 illustrates a simplified version of the apparatus 101 highlighting key components involved for operating and controlling the actuator moving in the direction toward the second side 103*b*, e.g. when subjected to an overrunning load. In practice, it is also desired to operate and control the actuator in the direction toward the first side 3*a* of the actuator 103, e.g. when subjected to an overrunning load. The same functionality is thus implemented by mirroring the configuration of the counterbalance valve 111 and check valve 114 on the other side of the actuator 103, and the full configuration for controlling the actuator movements and overrunning loads in both directions is shown in FIG. 7.

Figure 7:
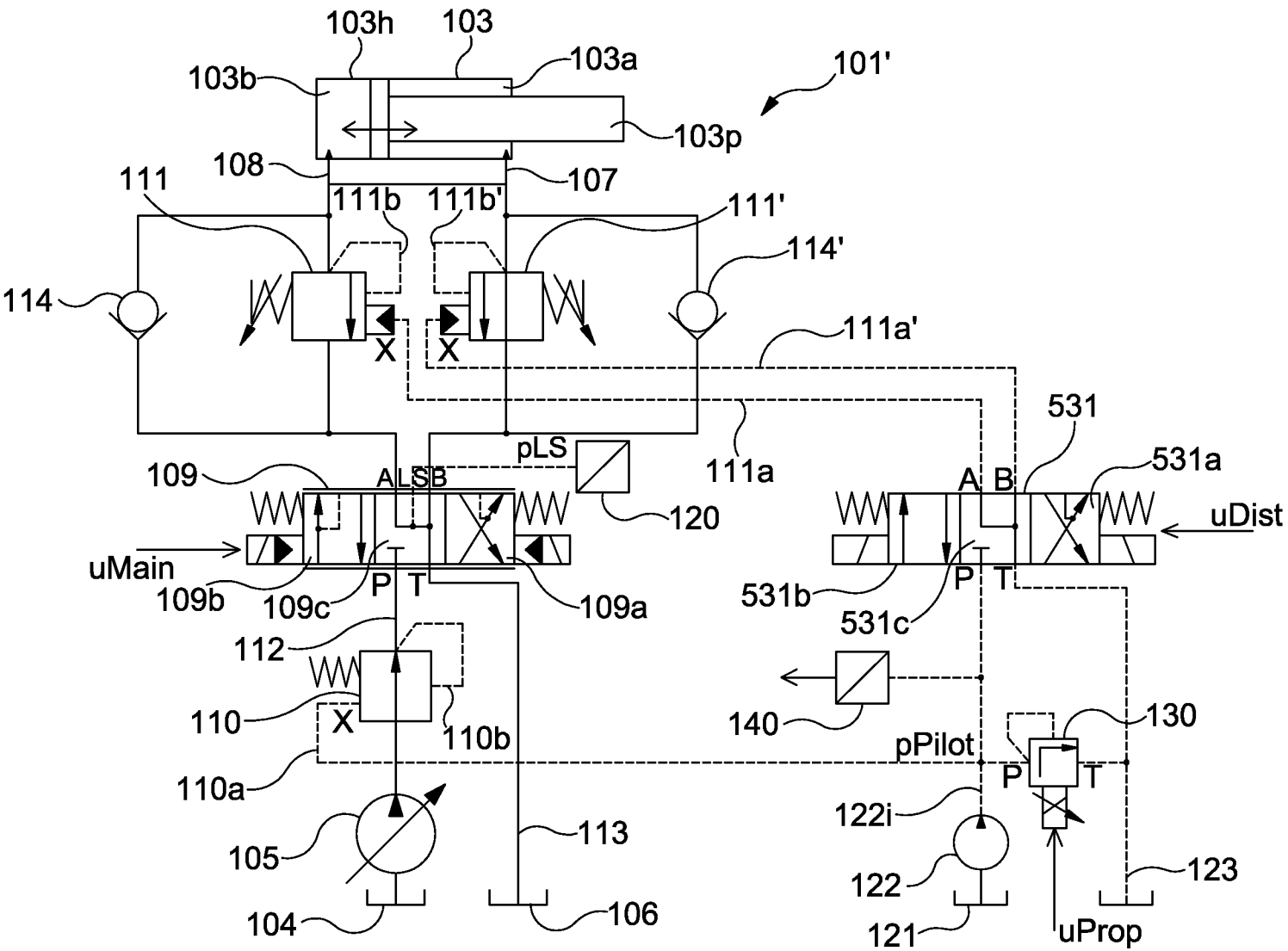
FIG. 7 is a diagram of apparatus for controlling an actuator according to another embodiment of the invention.

In FIG. 7, the apparatus 101' includes a second counter balance valve 111' operative under control from lines 111*b*' and 111*a*', and a second check valve 114'. These operate in alternation with the counterbalance valve 111 and check valve 114, and resist the movement of the piston 103*p* toward the first side 103*a*. The second counterbalance valve 111' and check valve 114' operate to resist the movement when the directional control valve 109 has the block 109*b* active, whereby the ports A and P are connected and ports B and T are connected. When the block 109*a* is active however, and ports A and T are connected and ports B and P are connected, the counterbalance valve 111 and check valve 114 operate to resist the movement toward the second side 103*b*.

The counterbalance valves 111, 111' uses separate control lines 111*a*, 111*a*' to the respective X ports of the valves 111, 111'. In order to supply control fluid on these lines 111*a*, 111*a*', the apparatus 101' has a pressure distribution valve in the form of a directional control valve 531, operating under control of the uDist signal (which in turn is linked to the uMain load sensing signal). When the piston 103*p* of the actuator 103 is being moved toward the second side 103*b* (upon application of power fluid into the chamber on the first side 103*a*), block 531*b* of the valve 531 is active and control fluid at the pilot pressure pPilot is communicated through the valve 531 into the line 111*a* and into the port X of the counterbalance valve 111. Conversely, when the piston 103*p* of the actuator 103 is being moved toward the first side 103*a* (upon application of power fluid into the chamber on the second side 103*b*), block 531*a* of the valve 531 is active and control fluid at the pilot pressure pPilot is communicated through the valve 531 into the line 111*a*' and into the port X of the second counterbalance valve 111'. The neutral configuration with block 531*c* active is shown in FIG. 7.

In other variants, other arrangements may be used to generate the pressure pPilot in the control fluid, not necessarily using the proportional pressure relief valve 130 as illustrated in FIGS. 3 and 4.

Figure 8:
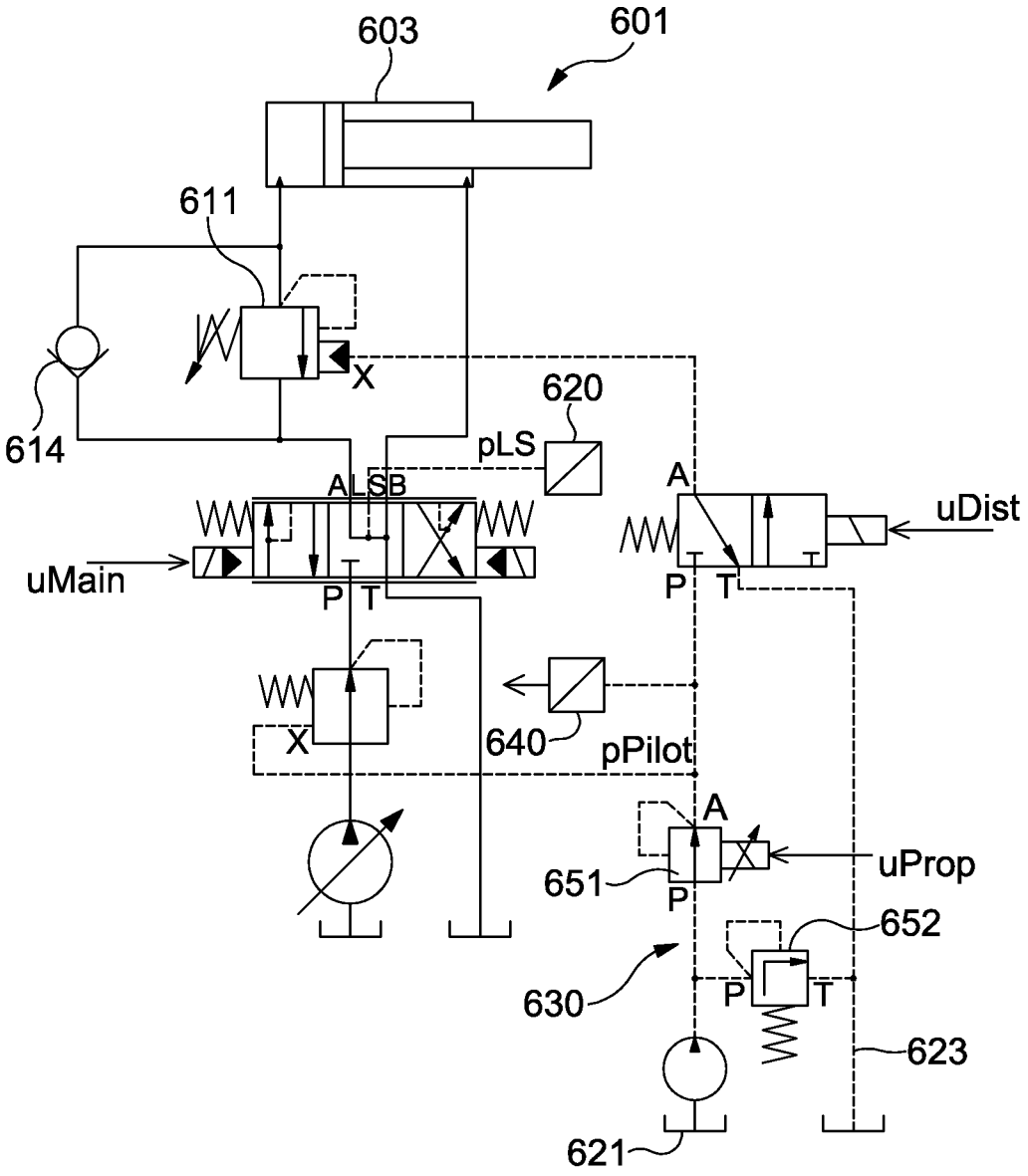
FIG. 8 is a diagram of apparatus for controlling an actuator according to a further embodiment.

Turning to FIG. 8, one such variant is depicted, in which the apparatus 601 has a valve arrangement 630 for generating the pilot pressure according using the uProp signal, instead of the pressure relief valve 130. The valve arrangement 630 in this example includes a proportional pressure reducing valve 651 which is used to generate the pilot pressure pPilot. A second valve 652 is provided between the pump 621 and the drain line 623 for bleeding off pressure to the drain line 623 to control the pressure of control fluid at the P port of the pressure reducing valve 651.

In the above-described embodiments, the pilot pressure pPilot which is generated from pSet as determined by the determiner 150 is communicated to both the counterbalance valve 111 and the proportional pressure relief valve 130. It will however be appreciated that the pressure pPilot from the determiner 150 can in other examples be applied to one or the other of the counterbalance valve 111 and the pressure compensating valve 110 (or the counterbalance valve 111' and the pressure compensating valve 110 as the case may be). Such examples are illustrated in FIGS. 9 and 10.

Figure 9:
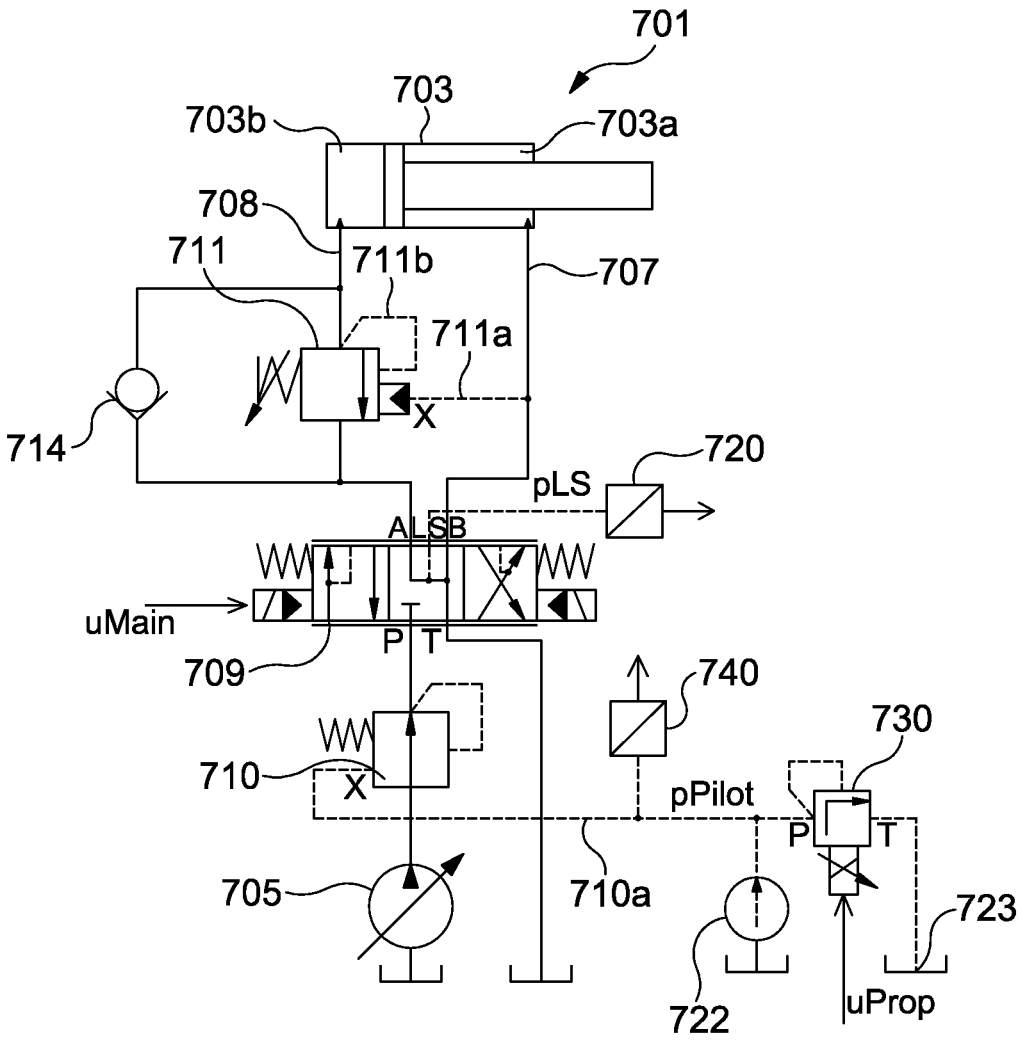
FIG. 9 is a diagram of apparatus for controlling an actuator according to yet a further embodiment.

In FIG. 9, the apparatus 701 is configured in the same way as the apparatus 101 of FIG. 3 except in this example the pressure pPilot from the determiner 105 is communicated through the line 710*a* to the X port of the pressure compensating valve 710 and not to the counterbalance valve 711. The pressure pLS is sensed by transducer 720 and fed to the determiner 150. The control line 711*a* is connected to the line 707 so that the X port of the counterbalance valve 711 senses the pressure in the fluid being supplied to the first side 703*a* of the actuator 703.

Figure 10:
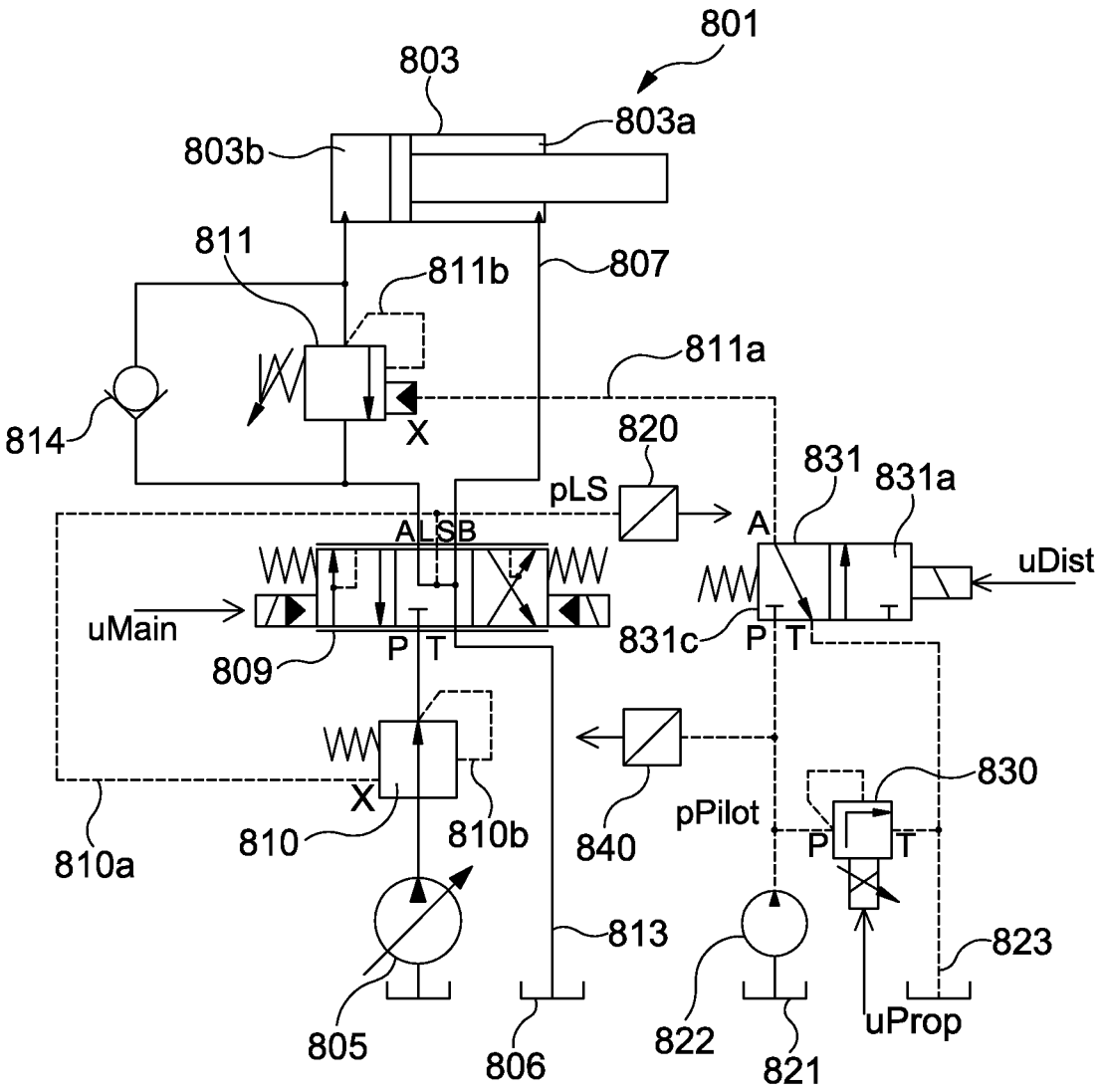
FIG. 10 is a diagram of apparatus for controlling an actuator according to yet a further embodiment.

In FIG. 10, the apparatus 801 is configured in the same way as the apparatus 101 of FIG. 3 except in this example the pressure pPilot from the determiner 105 is communicated through the line 811*a* to the X port of the counterbalance valve 811 and not to the pressure compensating valve 810. The pressure pLS is sensed by transducer 820 and fed to the determiner 150. The control line 810*a* is connected to an outlet side of the load-sensing directional control valve 809, which senses the pressure in the power fluid being supplied into the first side of the piston via line 807.

The configurations in FIGS. 9 and 10 represent simpler variants that may be effective while still offering improvements in the controllability of movement instabilities by overrunning loads, due to the pilot pressure pPilot being generated based on a computed set pressure pSet from the determiner 105. The system in FIG. 9 can be particularly advantageous because no artificially generated hydraulic pressure is sent to the counterbalance valve which is considered an important safety component. Therefore, the simpler system with the direct connection (provided by line 711*a*) may benefit from an easier certification requirement.

Figure 11:
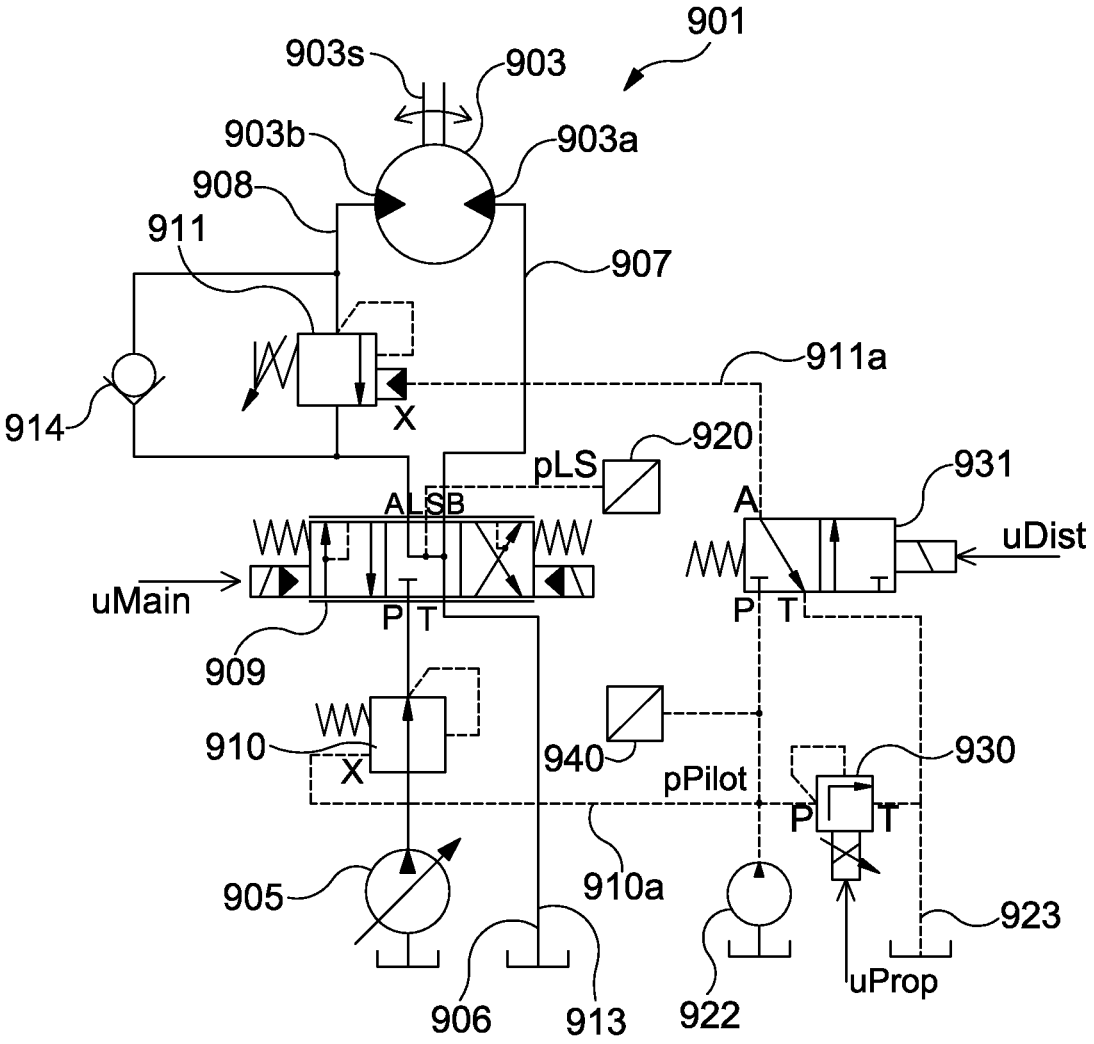
FIG. 11 is a diagram of apparatus for controlling an actuator in the form of a motor according to an embodiment of the invention.

It can be noted that the presently described techniques can be applied with actuators of different types. The actuators may be multi-directional in their movement, and may be controlled in respective directions using apparatus as described. For example, as illustrated in FIG. 11, rather than a bi-directional linear translation piston such as the pistons 103, 603, 703, 803, the actuator is in the form of a hydraulic motor 903 whereby a moving component in the form of a shaft 903*s* is rotated by hydraulic control. Shaft movement under load is controlled by an opposing pressure chamber. Thus, movement of the shaft 903*s* pressure in the line 907 into a first pressure chamber 903*a*, is resisted by fluid in a second pressure chamber 903*b* using the counterbalance valve 911.

Figure 12:
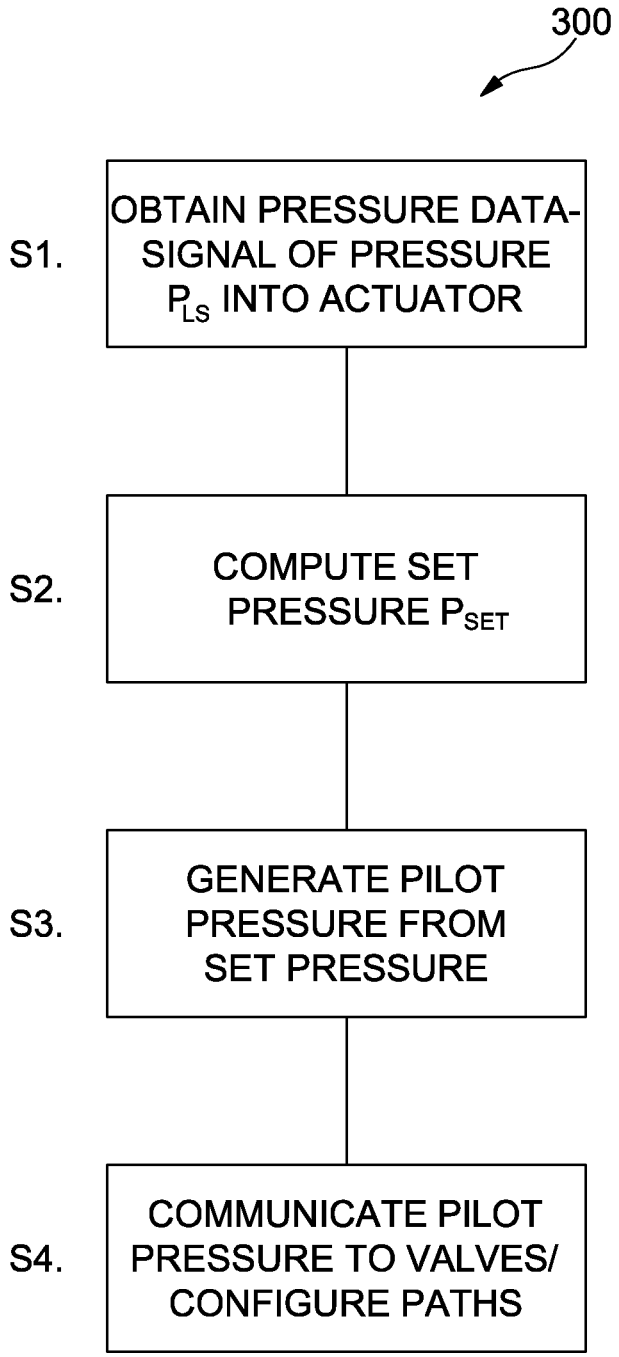
FIG. 12 is block diagram of a method according to an embodiment of the invention.

In FIG. 12, a method 300 of controlling a hydraulic actuator has the steps S1 to S4, as shown. In steps S1 and S2, pressure data providing a signal of the pressure in the power fluid into the actuator is obtained from transducer measurements, and a set pressure is computed based upon the pressure data, e.g. by filtering the signal. In S3, a pilot pressure is generated, e.g. using a pressure relief valve in a control fluid circuit, using the computed set pressure. In S4, the pilot pressure is produced in the control fluid and is communicated via the fluid to the ports in a counter balance valve and a pressure compensation valve, causing the valves to be set according to the pilot pressure. In this way, the paths for power fluid into and out of the actuator are determined by the valves in dependence on the pilot pressure to control the actuator.

Various modifications and improvements may be made without departing from the scope of the invention claimed below.

The invention claimed is:

1. A method of controlling an actuator during operation using a hydraulic circuit, the circuit comprising a pressure compensating valve, a counterbalance valve, a load-sensing directional control valve, a first path section along which a hydraulic fluid is supplied to a first chamber of the actuator via the pressure compensating valve, the hydraulic fluid being supplied to the first chamber via the load-sensing directional control valve, and a second path section along which the hydraulic fluid is extracted from a second chamber of the actuator via the counterbalance valve, the method comprising the steps of:

(a) obtaining pressure data associated with a pressure of the hydraulic fluid supplied to a first side of the actuator;

(b) producing a pilot pressure pPilot in a control fluid based on the pressure data;

(c) configuring the pressure compensating valve using the pilot pressure pPilot; and (d) configuring the counterbalance valve using the pilot pressure pPilot.

2. A method as claimed in claim 1, wherein the pressure data comprises a signal of the pressure in the hydraulic fluid supplied to the first chamber.

3. A method as claimed in claim 1, wherein the obtained pressure data are first pressure data, and the method further comprises processing the first pressure data to produce second pressure data, wherein the pilot pressure pPilot is produced based upon the second pressure data.

4. A method as claimed in claim 3, wherein at least one component from the first pressure data is preserved in the produced second pressure data.

5. A method as claimed in claim 3, wherein the step of processing the first pressure data to obtain the second pressure data comprises filtering the first pressure data.

6. A method as claimed in claim 5, wherein the step of filtering comprises applying a low-pass filter to the first pressure data.

7. A method as claimed in claim 3, which further comprises generating a control signal uProp based on the second pressure data, and passing the control signal uProp to a first valve to produce the pilot pressure pPilot for configuring both of the pressure compensating valve and the counterbalance valve.

8. A method as claimed in claim 7, wherein the first valve is operable to configure a valve control path for adjusting a pressure in the control fluid in the path.

9. A method as claimed in claim 7, which further comprises measuring the produced pilot pressure pPilot, comparing the measured pilot pressure with the second pressure data, and updating the control signal uProp in dependence upon the comparison.

10. A method as claimed in claim 1, wherein the obtained pressure data are first pressure data, and the method further comprises processing the first pressure data to determine at least one set pressure pSet for determining the pilot pressure pPilot.

11. A method as claimed in claim 1, wherein the pressure compensating valve is operable for adjusting a pressure of the fluid in the first path section.

12. A method as claimed in claim 1, wherein the counterbalance valve is operable for resisting undesired movement of the actuator.

13. A method as claimed in claim 1, wherein the pressure compensating valve and the counterbalance valve are configured to be operable to maintain an actuator speed that is independent of external disturbances on the actuator.

14. A method as claimed in claim 1, wherein the first path section comprises a metering-in line.

15. A method as claimed in claim 1, wherein pressure data associated with the pressure in the hydraulic fluid supplied to the first side of the actuator comprises at least one pressure pLS of the hydraulic fluid at an outlet of a load sensing directional control valve.

16. A method as claimed in claim 1, wherein the pressure compensating valve is positioned upstream of the load-sensing directional control valve.

17. Apparatus for operating and controlling a hydraulic actuator, the apparatus comprising:

a pressure compensating valve and a counterbalance valve;

a first path section along which a hydraulic fluid is supplied to a first chamber of the actuator using the pressure compensating valve;

a second path section along which the hydraulic fluid is extracted from a second chamber of the actuator using the counterbalance valve;

a load-sensing directional control valve wherein the hydraulic fluid is supplied to the first chamber via the load-sensing directional control valve; and at least one device for producing a pilot pressure pPilot in a control fluid based upon obtained data associated with a pressure of the hydraulic fluid supplied to the first chamber of the actuator, wherein both of the pressure compensating valve and the counterbalance valve are configured using the pilot pressure pPilot.

18. Apparatus as claimed in claim 17, further comprising the actuator.

19. Apparatus as claimed in claim 17, wherein said at least one device comprises any one or more of: a determiner; a controller; and a control structure.

20. Apparatus as claimed in claim 17, further comprising a control fluid circuit, or components thereof, for controlling both of the pressure compensating valve and the counterbalance valve.

21. Apparatus as claimed in claim 17 further comprising a computer device configured to receive data associated with a pressure of the hydraulic fluid supplied to the first chamber of the actuator, for determining a pilot pressure pPilot to be generated based upon the obtained data for configuring both of the pressure compensating valve and the counterbalance valve.

22. Apparatus as claimed in claim 17, wherein:

the pressure compensating valve is operable for adjusting a pressure of the hydraulic fluid in the first path section; and the counterbalance valve is operable for resisting undesired movement of the actuator.

23. Apparatus as claimed in claim 17, wherein the pressure compensating valve is positioned upstream of the load-sensing directional control valve.

24. A non-transitory machine-readable storage medium encoded with instructions executable by a processor for controlling an actuator using a hydraulic circuit, the hydraulic circuit comprising a first path section along which a hydraulic fluid is supplied to a first chamber of the actuator using a pressure compensating valve, and a second path section along which the hydraulic fluid is extracted from a second chamber of the actuator using a counterbalance valve, hydraulic circuit further comprising a load-sensing directional control valve, the hydraulic fluid being supplied to the first chamber via the load-sensing directional control valve, the machine-readable storage medium comprising:

instructions to receive data associated with a pressure of the hydraulic fluid supplied to the first chamber of the actuator;

instructions to determine a pilot pressure pPilot in a control fluid based upon the received data;

instructions to configure both of the pressure compensating valve and the counterbalance valve using the pilot pressure pPilot.

25. Non-transitory machine-readable storage medium as claimed in claim 24, wherein:

the pressure compensating valve is operable for adjusting a pressure of the hydraulic fluid in the first path section; and the counterbalance valve is operable for resisting undesired movement of the actuator.

26. A method of controlling an actuator during operation using a hydraulic circuit comprising a first path section along which a hydraulic fluid is supplied to a first chamber of the actuator using a pressure compensating valve, and a second path section along which the hydraulic fluid is extracted from a second chamber of the actuator using a counterbalance valve, the hydraulic circuit further comprising a load-sensing directional control valve, the hydraulic fluid being supplied to the first chamber via the load-sensing directional control valve, the method comprising the steps of:

(a) computing a set pressure pSet in a control fluid in dependence upon a pressure of the hydraulic fluid supplied to the first chamber of the actuator; and (b) configuring both of the pressure compensating valve and the counterbalance valve based on the computed set pressure.

27. A method as claimed in claim 26, wherein:

the pressure compensating valve is operable for adjusting a pressure of the hydraulic fluid in the first path section; and the counterbalance valve is operable for resisting undesired movement of the actuator.

* * * * *